United States Patent [19]

Diceglie

[11] 4,096,656

[45] Jun. 27, 1978

[54] LIGHTED MESSAGE BOARD CONSTRUCTION

[76] Inventor: Giacomo Diceglie, Box 252, Windermere, Fla. 32786

[21] Appl. No.: 747,358

[22] Filed: Dec. 3, 1976

[51] Int. Cl.[2] ..... G09F 13/00

[52] U.S. Cl. ..... 40/564; 40/152.2

[58] Field of Search ..... 40/130 R, 132 R, 130 E, 40/152.2, 130 L, 106.52, 152; 272/8 D; 240/10 T, 2.1

[56] References Cited

U.S. PATENT DOCUMENTS

| | | | |
|---|---|---|---|
| 721,194 | 2/1903 | Horn | 40/130 E X |
| 1,190,600 | 7/1916 | Shreves et al. | 40/152.2 X |
| 1,192,982 | 8/1916 | Bristol | 40/130 L X |
| 1,480,375 | 1/1924 | Cristadoro | 40/152.2 X |
| 2,429,420 | 10/1947 | McMaster | 240/2.1 |
| 2,509,250 | 5/1950 | Goffsten | 40/130 |
| 2,588,545 | 3/1952 | Lawrence | 40/152.2 |
| 3,226,866 | 1/1966 | de Poray | 40/106.52 X |

*Primary Examiner*—Louis G. Mancene
*Assistant Examiner*—Wenceslao J. Contreras
*Attorney, Agent, or Firm*—Duckworth, Hobby, Allen & Pettis

[57] ABSTRACT

A lighted message board includes a border of an insulating material with a plurality of conductive layers deposited thereon, and with a plurality of individual lighting elements carried by the border and interconnected with selected ones of the conductive layers. A sequencing and timing circuit is connected with the conductive layers for energizing the lighting element, and for intermittently operating the lighting elements. A transparent layer overlies the border and the lights, and a message panel is bonded to the face of the transparent layer.

20 Claims, 4 Drawing Figures

LIGHTED MESSAGE BOARD CONSTRUCTION

BACKGROUND OF THE INVENTION

1. Field of the Invention

The present invention relates to signs and message boards, and in particular to signs and message boards having an illuminated border.

2. Description of the Prior Art

There are a wide variety of prior art structures for lighted message boards and signs. In U.S. Pat. No. 3,318,032, Robison et al discloses an illuminated display frame in which a light is carried by a support member, with a transparent layer positioned in front of the lights for illuminating the picture carried between the transparent border and the support.

In U.S. Pat. No. 2,792,648, Coss discloses an electrical decorating model employing a plurality of lighting elements positioned within a case for displaying articles therein.

In U.S. Pat. No. 3,742,203, Noe discloses an adjustably illuminated picture frame in which the position of the lighting element may be moved with respect to the object being illuminated. Gargas in U.S. Pat. No. 3,824,723, discloses a multiple transparency display unit and sequencing control.

Other prior art of interest includes the following U.S. patents: Batchelor No. 2,097,400; Du Rand No. 3,294,397; Chao No. 3,918,184; and Reed No. 3,573,792.

SUMMARY OF THE INVENTION

The present invention contemplates a lighted message board construction comprising a border of an insulating material with a plurality of conductive layers deposited on one side of the border, and with a plurality of individual lighting elements carried by the border and interconnected with selected ones of the conductive layers. Electrical means are connected with the conductive layers for energizing the lighting elements, and is carried by the border for intermittently operating the lighting elements. A message panel is positioned adjacent the border with the lighting elements around the outer edge thereof.

In a preferred embodiment, a transparent layer is also positioned in front of the border and the lighting element, with the message panel mounted against the transparent layer. A support is provided behind the border, and including a peripheral portion closing about the periphery of the border and mating with the periphery of the transparent layer.

DETAILED DESCRIPTION

A preferred embodiment of a lighted message board constructed in accordance with the present invention will now be described with reference to the drawings.

Figure 1:
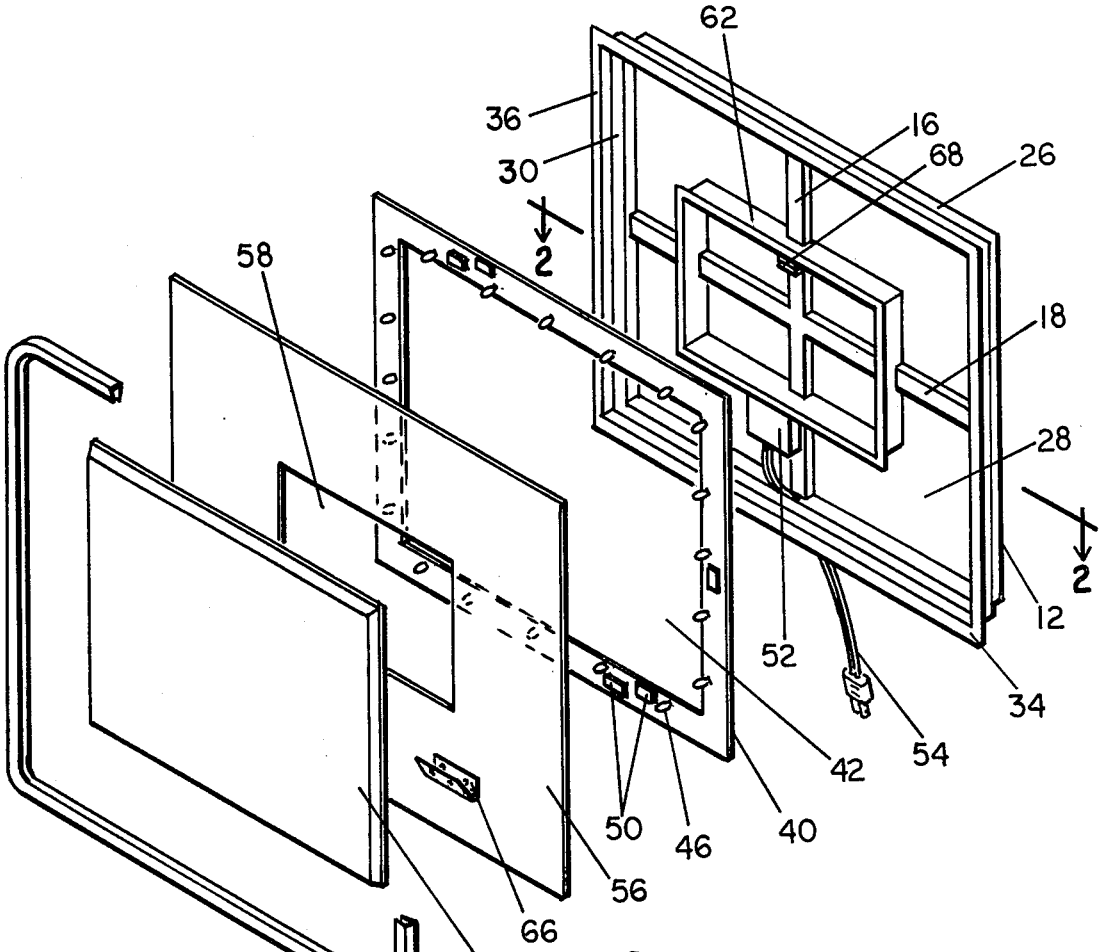
FIG. 1 is a perspective view, partially cut away, of a lighted message board constructed in accordance with the present invention.
Figure 4:
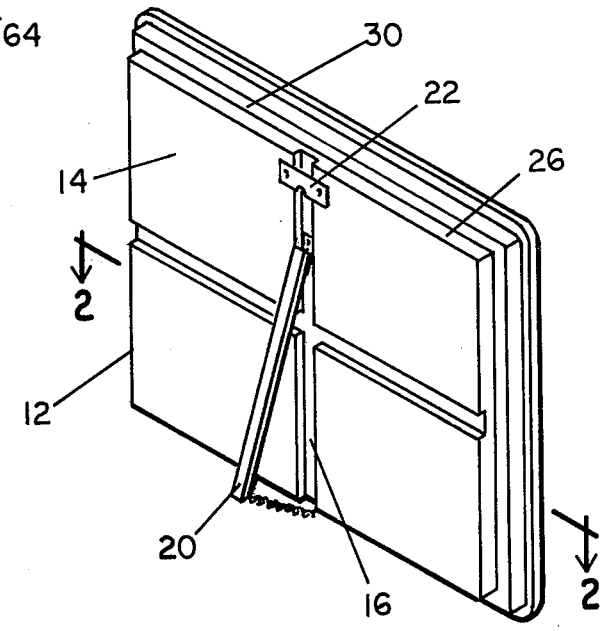
FIG. 4 is a perspective view of the rear of the message board shown in FIG. 1.
Figure 2:
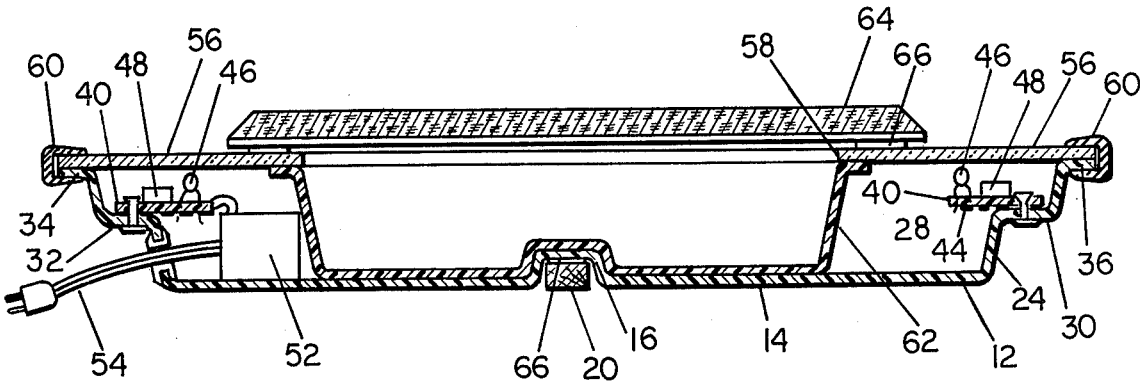
FIG. 2 is a cross-section of the message board shown in FIG. 1, taken along the lines 2—2.

With particular reference to FIGS. 1, 2 and 4, the lighted message board, referred to generally by the numeral 10, includes a support 12 having a back 14 with structurally strengthening recesses 16 and 18 molded therein. A stand 20 may be engaged in one of the recesses 16 such that the message board 10 may be propped in a standing position. The message board 10 is also provided with a hanger 22 so that the message board may be alternatively hung from a wall or similar structure.

Referring now to FIGS. 1 and 2, the support 12 further includes opposing side walls 24, 26 defining an interior space 28 within the support 12. Each side wall further defines an outward step 30, 32, respectively, and a flange 34, 36, both the step and flange of each side extending outwardly with respect to the interior 28 of the support 12. It will be understood that the support 12 may constitute a unitary molded material, such as fiberglass.

Figure 3:
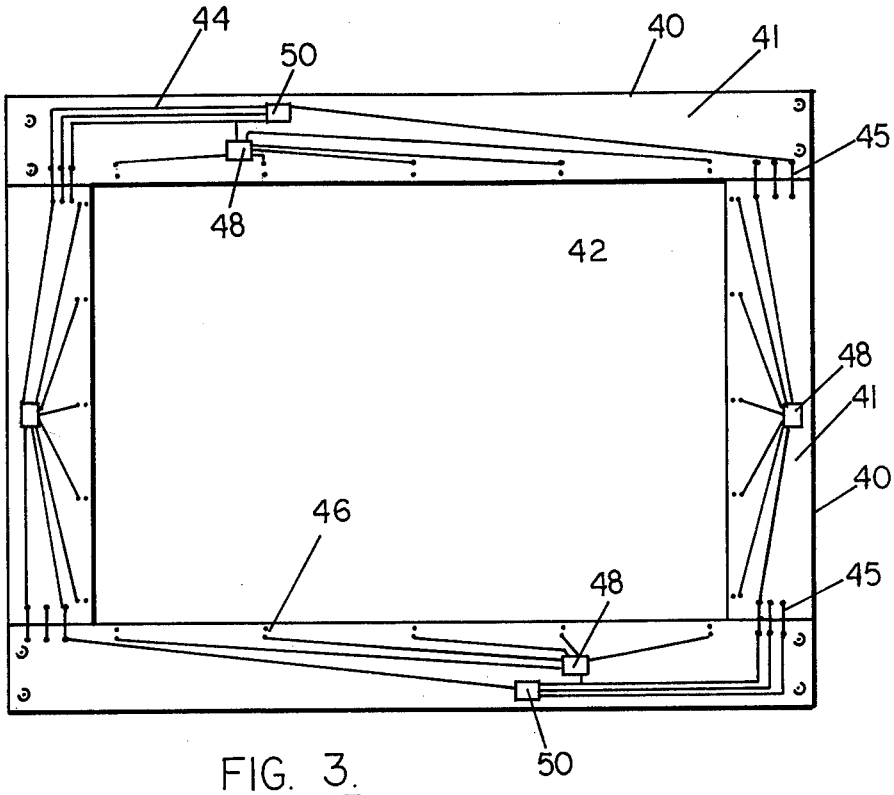
FIG. 3 is a front view of an alternate arrangement of the insulating sheet 40 of FIGS. 1 and 2.

Reference is now made to FIGS. 1, 2 and 3. The message board further includes an illuminated border for eye appeal purposes. This lighted border is defined by an insulating sheet 40 having a central hole 42 therein. The sheet 40 may constitute a sheet of a single thickness, as shown in FIGS. 1 and 2, or alternatively, may comprise a series of flat strips 41 joined together, as shown in FIG. 3. It will be clear to those skilled in the art that a substantial savings is realized in the construction of FIG. 3, since the border need not be cut out of a single piece of flat stock (as in FIGS. 1 and 2) with a commensurate waste of stock material.

The insulating sheet 40 shown in FIGS. 1, 2 and 3 includes a plurality of conductive layers 44 which are deposited along one face of the sheet 40, and in which the conductive layers on one side of that face are interconnected with the conductive layers on an adjacent side of the same face. In the example of FIGS. 1 and 2, this arrangement comprises of a continuous metallic layer deposited in the fashion of printed circuit boards and the like. In the example of FIG. 3, the interconnection between adjacent strip 41 may be made by means of wire straps 45 between adjacent ones of the strip. As shown in FIG. 1, the face of the sheet 40 upon which the conductive layers are deposited bears against the step 30 and 32 of the side walls 24, 26 respectively.

Noting FIGS. 1 and 2, the message board 10 includes a plurality of lighting elements 46 mounted on a face of the sheet 40 opposing the one face upon which the conductive layers 44 are deposited. Each lighting element 46 includes a pair of conductors which extend through the sheet 40 and are interconnected with selected ones of the conductive layers 44. As shown in FIGS. 2 and 3, the message board 10 is further provided with a plurality of sequencing circuits 48 which are carried by the sheet 40; preferably, there are four sequencing circuits, each of which are positioned along one side of the first face of the sheet 40. Each sequencing circuit 48 is interconnected with selected ones of the conductive layers 44 and with a timing circuit 50, the timing circuit 50 being controlled by a power supply and clock circuit 52 (FIG. 2) which in turn is powered by an electrical power cord 54, in such a manner that the timing circuit 50 sequentially operates the sequencing circuits 48, which in turn sequentially operate the lighting elements 46 along each side of the sheet 40 to thereby obtain sequential light operation in a desired manner. It will be understood that these sequencing circuits may constitute well known integrated circuits, and as such as shown by block diagram only.

Noting again FIGS. 1 and 2, the message board 10 is further provided with a transparent layer 56 overlying the insulating sheet 40 and extending between the two flanges 34, 36 such that the periphery of the transparent layer is flush with these flanges. Preferably, the transparent layer 56 includes a central hole 58 allowing access to a storage container, described in greater detail below.

A U-shaped vinyl strip 60 overlaps the flanges 34, 36 and the periphery of the transparent layer 56 as a trim edge. The transparent layer 56 and the flange 34, 36 may be bound together by a suitable adhesive.

As described above, the message board 10 may further include a storage container 62 which is accessible through the central holes 42 and 58 through the sheet 40 and the transparent layer 56, respectively.

The message board is also provided with a message panel 64 which is mounted flush with the transparent layer 56. The message panel 64 may be bonded directly to the outer surface of the transparent 56, or alternatively, as shown in FIGS. 1 and 2, the message panel 64 may be pivoted above a hinge 66 along the bottom side of the panel, with a fastener 68 along the top edge of the storage container 62 such that the message panel may be rotated away from the transparent layer 56 to allow access through the holes 42 and 58 to the storage container. In this way, letters and numerals which are mounted on the message panel 64 may be removed and stored within the message board 10.

In use, the message board is mounted in a substantially vertical position by use of the stand 20 or the wall hanger 22; alternatively, the message board 10 may be mounted on an easel or the like. The power cord 54 is installed in a typical wall socket providing line current to the power supply and clock circuit 52 which in turn energizes the timing and sequencing circuits 50 and 48, respectively. These circuits in turn initiate sequential operation of the lighting elements 46 in the desired manner. Preferably, the transparent layer 56 comprises a smoked Plexiglas or similar partially transparent material in which the construction features within the interior 28 of the support are not visible, but in which the lights 46 can be seen when illuminated during sequential operation.

I claim:

1. A lighted message board comprising:
a support defined by a back and opposing side walls;
a sheet of an insulating material within said support and substantially parallel with said back;
a plurality of conductive layers deposited on one side of said sheet;
a plurality of lighting elements carried by said sheet, each lighting element interconnected with selected ones of said conductive layers;
means electrically connected with said conductive layers for energizing said lighting elements;
a transparent layer overlying said support across the extremities of said side walls;
means for binding the periphery of said transparent layer to the periphery of said side wall; and
a message panel carried by said transparent layer.

2. The lighted message board recited in claim 1 wherein said transparent layer comprises smoked Plexiglas.

3. The lighted message board recited in claim 1 wherein said message board is bonded to said transparent layer.

4. The lighted message board recited in claim 1 wherein said message panel overlies said transparent layer.

5. The lighted message board recited in claim 4 further comprising means for hinging said message panel to said transparent layer along one side.

6. The lighted message board recited in claim 5 further comprising means for releasably fastening a side of said message panel opposite said one side to said transparent layer.

7. The lighted message board recited in claim 6 further comprising a storage container carried within said support, said transparent layer including a centrally located hole therein, with said storage container accessible through said hole in said layer by unfastening said message panel and pivoting said message panel about said hinging means.

8. The lighted message board recited in claim 1 wherein said insulating material includes first and second opposed flat surfaces, said first surface facing said support and having said conductive layers deposited thereon.

9. The lighted message board recited in claim 8 wherein said second surface faces said transparent layer, said lighting elements carried by said second surface and having conductive leads extending through said insulating material and interconnecting with said conductive layers.

10. The lighted message board recited in claim 9 wherein said insulating material is defined by four sides, each side having a plurality of said lighting elements thereon.

11. The lighted message board recited in claim 10 wherein said energizing means comprises sequencing circuit means positioned on each side for sequentially energizing said lighting elements on the corresponding side.

12. The lighted message board recited in claim 11 further comprising timing circuit means coupled to all of said sequencing circuit means for timing the operation thereof.

13. The lighted message board recited in claim 1 wherein said support includes a structural recess along the backside thereof, and a stand slidably engaged in said recess.

14. The lighted message board recited in claim 1 wherein said side wall of said support define a flange at the extremities thereof, said transparent layer bearing against said flange.

15. The lighted message board recited in claim 14 wherein said binding means comprises a resilient strip having a generally U-shaped cross-section overlapping said flange and the periphery of said transparent layer.

16. The lighted message board recited in claim 14 wherein said sheet includes first and second opposed flat surfaces, said first surface facing said support and having said conductive layers deposited thereon.

17. The lighted message board recited in claim 16 wherein said second surface faces said transparent layer, said lighting elements carried by said second surface and having conductive leads extending through said sheet and interconnected with said conductive layers.

18. The lighted message board recited in claim 17 wherein said sheet is defined by four sides, each side having a plurality of said lighting elements thereon.

19. The lighted message board recited in claim 18 wherein said intermittent operating means comprises sequencing circuit means positioned on each side for sequentially energizing said lighting elements on the corresponding side.

20. The lighted message board recited in claim 14 further comprising each said opposing side wall further defining an outward step with respect to the interior of said support and between said flange and said back, said sheet extending across the interior of said support and bearing against said step of each said side wall.

* * * * *